United States Patent [19]

Payen

[11] Patent Number: 4,525,992

[45] Date of Patent: Jul. 2, 1985

[54] PROCESS FOR MAKING COVERED ELASTANE YARN

[75] Inventor: Pierre Payen, Lyons, France

[73] Assignee: L. Payen and Cie, S.A., Lyons, France

[21] Appl. No.: 436,738

[22] Filed: Oct. 26, 1982

[30] Foreign Application Priority Data

Nov. 2, 1981 [FR] France ..... 81 20711

[51] Int. Cl.[3] ..... D02G 3/32

[52] U.S. Cl. ..... 57/18; 57/12; 57/225; 57/313

[58] Field of Search ..... 57/3, 12, 16–18, 57/313, 225, 226

[56] References Cited

U.S. PATENT DOCUMENTS

| | | | |
|---|---|---|---|
| 2,061,021 | 11/1936 | Chittenden et al. | 57/18 X |
| 2,254,712 | 9/1941 | Shepherd | 57/225 X |
| 2,263,612 | 11/1941 | Chittenden | 57/12 |
| 3,257,793 | 6/1966 | Abbott | 57/313 X |
| 3,596,459 | 8/1971 | Wada et al. | 57/12 X |

FOREIGN PATENT DOCUMENTS

| | | |
|---|---|---|
| 2145109 | 1/1973 | France . |
| 2184230 | 11/1973 | France . |
| 2185207 | 12/1973 | France . |
| 443188 | 2/1936 | United Kingdom . |

*Primary Examiner*—John Petrakes
*Attorney, Agent, or Firm*—Parkhurst & Oliff

[57] ABSTRACT

The present invention relates to a process for covering an elastane yarn stretched by three to five times, with a covering yarn, characterised in that it consists:

in a first phase, in covering the drawn elastane yarn with the covering yarn with a twist of the order of one third the usual twist of single-covering, and in receiving this covered yarn on a bobbin, then, in a second phase, in taking up this bobbin of covered yarn on a twisting member to communicate thereto an additional twist until a twist which is equal to the usual twist of single-covering is obtained on this yarn.

5 Claims, 2 Drawing Figures

PROCESS FOR MAKING COVERED ELASTANE YARN

Figure 1:
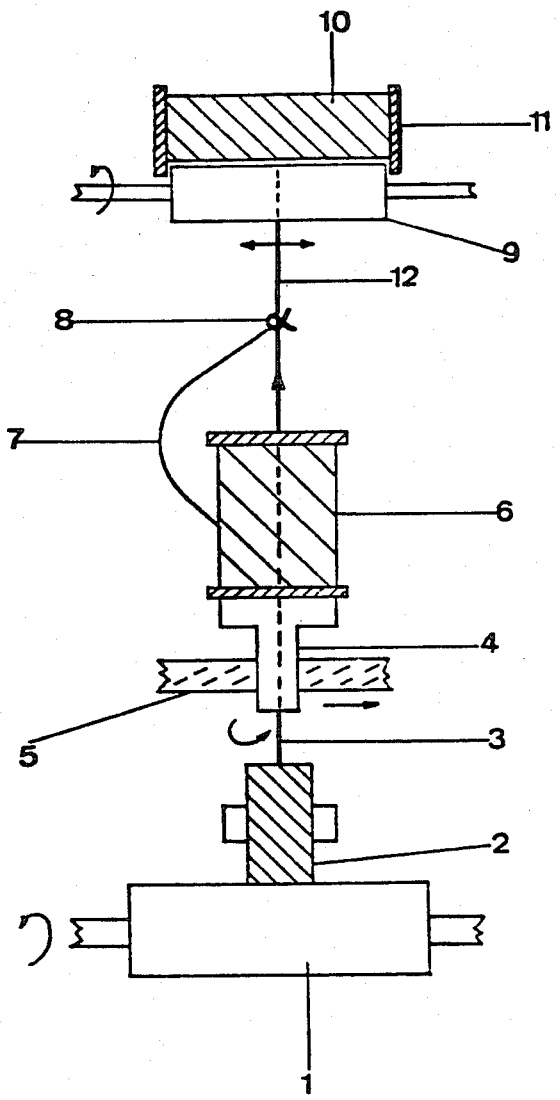

The present invention relates to a process for manufacturing covered elastane yarn and more particularly to a process for manufacturing single-lapped elastane yarn.

An "elastane" yarn is an elastofibre composed of at least 85% (by mass) of a segmented polyurethane.

It has been known for a long time to make such yarns by the so-called wrapping or lapping or covering technique, and particularly by the so-called single-lapping or single-covering technique. To this end, the elastane yarn is firstly drawn or stretched by three to five times, then a so-called covering yarn, particularly a texturized yarn, is wound therearound in preferably contiguous turns. In practice, the twist of covering which varies inversely with respect to the size of the covering yarn is of the order of 1000 to 3000 t/m, since it is desired to obtain substantially contiguous turns. When it is desired to make optimum single-covered yarns with the minimum of bulk, such as the yarns sought to manufacture hosiery legs, fairly fine, i.e. 20 to 40 denier, yarns are currently used which are covered by a synthetic yarn, texturized or not, of 15 to 30 deniers, wrapped with twists of the order of 1500 turns per metre (t/m). In the application of the yarn to stockings or tights, it is indispensable that the stretched elastane core yarn be entirely covered by the wrapping yarn in order to be protected, in particular, from fraying.

Although this technique is very wide-spread, it nonetheless presents certain drawbacks among which may be mentioned:

- the practical impossibility of obtaining knotless windings whose weight exceeds one kilo, on the one hand due to the very lapping equipment and on the other hand because, beyond this weight, too high tensions would then be obtained on the covering yarn, which would provoke on the finished covered yarn the defect known as "flash", by virtue of which the core yarn is not perfectly covered in places, which renders the fabrics non-aesthetic and even weak; and
- a high cost price due to the appreciable consumption of electricity necessitated by the rotation of the bobbin of wrapping yarn.

British Pat. No. 443,188 proposes a process whereby, in a first step, an elastic rubber yarn is assembled in parallel with two previously twisted yarns, then, in a second step, two of these yarns thus assembled are twisted. In this way, an elastic organzine yarn is obtained. Unfortunately, this yarn cannot be suitable for manufacturing stockings or tights since, on the one hand, it is economically impossible to make fine yarns and on the other hand, and especially, the elastic core yarn, due to the technique of assembly, is not well covered, therefore is poorly protected from fraying, which is inacceptable.

It is an object of the invention to overcome these drawbacks and it relates to a process which is economical at the same time as allowing larger windings to be made.

This process for covering an elastane yarn stretched by three to five times, with a so-called covering yarn, is characterised in that it consists:

- in a first phase, in covering the stretched elastane yarn with the covering yarn with a twist of the order of one third the usual twist of single-covering and in receiving this assembled yarn on a bobbin,
- then, in a second phase, in taking up this bobbin of yarn on a twisting member to communicate thereto an additional twist until a total twist is obtained on the yarn which is equal to the usual twist of single-covering.

In practice, and advantageously:

during the first phase:

- the covering yarn is a synthetic yarn, texturized by false twist, or not
- the twist of assembly is of the order of 600 t/m, (twists/meter),
- assembly is effected with a single-covering machine.

during the second phase, the additional twist is given by a double twist spindle and reception is effected on a biconical bobbin in order to facilitate drawing of the yarn during knitting.

The "usual single-covering twist" of a stretched elastane yarn is perfectly well known to technicians. This is the usual twist given to the covering yarn by the covering machine to cover, completely, the drawn or stretched elastane core yarn, i.e. to cover this drawn core yarn with contiguous, but not superposed turns of the covering yarn. As has already been stated, this twist varies inversely with respect to the size of the covering yarn—the finer the covering yarn, the higher this twist. In practice, it is between 1000 and 3000 t/m.

Applicants' French patent No. 72 18229, published under No. 2 185 207, had already suggested assembling an elastane yarn and another yarn with the double twist spindle. Unfortunately, in the assembly thus effected, the stretched elastane yarn was often poorly protected, which rendered use thereof unacceptable in many applications. Consequently, this technique had to be abandoned.

As has already been stated, during the first phase, the twist of covering must be of the order of one third of the usual twist of single-covering. If this twist were lower, a lapping or covering would not be obtained, but an assembly in which the elastane yarn would not be positioned at the centre, i.e. as the core, but, on the contrary, would periodically come to the surface, so that, during the additional twist, this surface presence would be accentuated. The yarn thus obtained would be fragile, as the elastane yarn would be poorly protected, therefore subject to fraying. On the other hand, if the twist communicated during the first phase in too strong, for example greater than half the usual twist of single-covering, the "flash" defect would reappear and even be accentuated after the second phase, not to mention the unnecessarily high cost of such an operation.

Figure 2:
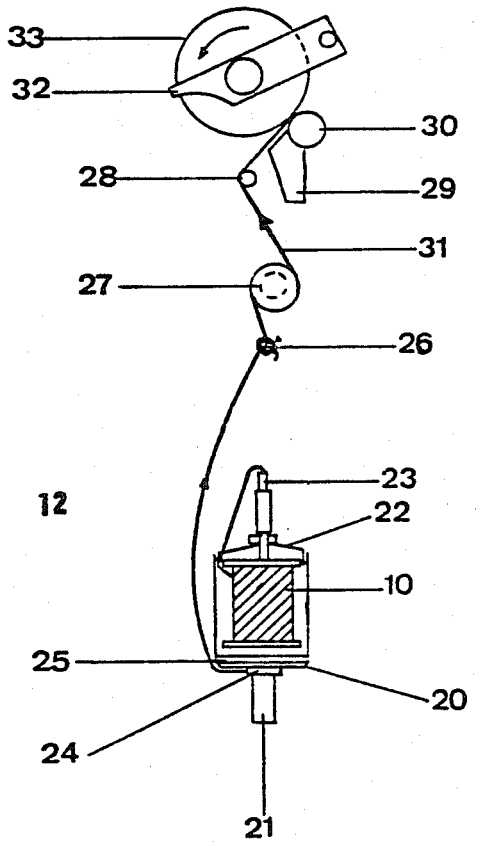

The invention will be more readily understood on reading the following description with reference to the accompanying drawings, in which:

FIG. 1 shows, in section, a summary assembly for carrying out phase 1, and FIG. 2 is a likewise summary assembly, seen in section, for carrying out phase 2.

Referring now to the drawings, the following references designate:

Phase 1 (FIG. 1)

(1) the delivery roll
(2) the bobbin of elastane
(3) the stretched elastane yarn,
(4) the hollow spindle rotated by the belt (6) the bobbin of covering yarn (7)
(8) the lapping or covering eyelet
(9) the drive cylinder behind which is placed the conventional yarn-guide (not shown) animated by a transverse reciprocating movement
(10) the winding on flanged bobbin (11) from the assembled yarn (12) obtained.

Phase 2 (FIG. 2)

(12) the yarn covered in phase 1
(21) the pulley of the double twist spindle (for example of the type DT 2055 of ACBF)
(22) a spindle cap
(23) the twist blocker of the actual double twist spindle rotated by (21) on which the bobbin (10) of yarn (12) is placed
(24) the magazine
(25) the disc
(26) a balloon-fixing eyelet
(27) the high speed delivery roll
(28) a guide
(29) the wind guide
(30) the starting and wind cylinder
(31) the finished wrapped yarn
(32) the stirrup holding bobbin (33) for example of the biconical type on which the finished yarn (31) is received.

EXAMPLE 1

On a single-covering machine (shown in FIG. 1) are assembled:

as core (3): a 40 denier elastane yarn stretched by about four times (500 g bobbin 2);
as covering yarn (7): a false twist texturized yarn in polyamide 6.6 of 20 deniers/7 filaments wound from a 1 kg bobbin (6);
the spindle (4) rotates at about 11,000 t/m in S form, this giving a covered yarn (12) with a twist of covering of about 700 t/m in S form.

Reception (10) is effected on a bobbin (11) with a diameter of 120 mm and a stroke of 200 mm.

This bobbin (10) is then placed (cf. FIG. 2) on a double twist spindle of type 2055 ACBF with a pot diameter of 140 mm. During this treatment, this bobbin (10) is therefore fixed or stationary.

The speed of rotation of the spindle (22–24) is about 15,000 t/m in S form, this giving the yarn (31) an additional twist of 1200 t/m in S. form. The yarn (31) therefore presents a final twist of 1200 plus 600, i.e. 1800 t/m in S form. The bobbin 33 obtained weighs about 1.5 kg against 1 kg in the presently most favourable cases starting from the single-covering machine.

The yarn (31) obtained presents excellent elasticity and a very good cover, with the result that, for the majority of usual applications, the conventional heat treatments fixation may advantageously be eliminated. This yarn is perfectly suitable for manufacturing woven or knitted fabrics, particularly for the legs of hoisery.

This yarn (31) may easily be identified with respect to a conventional single-covering yarn. In fact, in a conventional single-covering yarn, if the yarn is disassembled, a twist is then communicated to the core yarn which is equal to the twist of covering. In this way, for a yarn covered at 1800 turns during disassembly, the core yarn receives a twist of 1800 turns in Z form.

On the other hand, with a yarn prepared according to the invention, if this yarn is disassembled, the core is then twisted by a value equal to that received during twisting of the first phase. In this way, in this yarn which has been twisted at 1800 t/m in S form, if a reverse twist of 1800 t/m in Z form is communicated in order to be able to separate the core and the covering yarn, only a twist of 600 turns in Z form is then found on the core yarn and not 1800 turns as with a single-covered yarn.

EXAMPLE 2

Example 1 is repeated, but using:

as core (3): a 70 denier elastane yarn stretched by about three and a half times;
as covering yarn (7): a raw yarn of polyamide 6.6 of 30 deniers/10 filaments.

In addition, the twist in phase 1 is 700 t/m in S form, whilst in phase 2 it is 1400 t/m in S form, which gives a final twist of 2100 t/m in S form.

The yarn obtained presents the same properties as the one obtained in Example 1.

EXAMPLE 3

Example 1 is repeated, but replacing the texturized covering yarn (7) by a raw yarn of the same nature and size. The twist of the first phase of covering is taken to 700 t/m. The rotation of the double twist spindle (22–24) is fixed at 13,000 t/m, which gives an additional twist of 1400 t/m. The yarn (31) therefore presents a final twist of 2100 t/m in S form.

EXAMPLE 4

Example 1 is repeated, but replacing the core yarn (3) by a 20 denier elastane yarn stretched by four times and the covering yarn (7) by a raw polyamide 6.6 yarn of 17 dtex/5 filaments.

The twist of covering of the first phase is 850 t/m in S form. The additional twist given by the double twist spindle 22–24 is 1650 t/m in S form. The finished yarn (31) has a final twist of 2500 t/m in S form. This yarn is perfectly suitable for manufacturing tights or stockings.

In order to avoid spirality of the leg of these stockings and to obtain perfectly balanced products, it is recommended to knit one feed with such an S-twisted yarn and the following feed with the same yarn but Z-twisted.

The process according to the invention presents numerous advantages over processes used at present. The following may be mentioned:

the possibility of obtaining, industrially, bobbins of much higher weight (1.5 kg against 1 kg at present, or an increase of the order of 50%)
energy consumption reduced by about 30%.
therefore a substantial decrease in the cost price.

Consequently, these yarns may be successfully used for all known applications of single covered yarns.

What is clamed is:

1. A process for covering an elastane yarn stretched from three to five times, comprising the steps of:

disposing a single covering material with a twist in the range of $\frac{1}{3}$ to $\frac{1}{2}$ the usual twist of a single covering, over a stretched elastane yarn, forming a covered yarn;
winding said single covered yarn on a bobbin, forming a bobbin of covered yarn;
taking up said bobbin of covered yarn onto a twisting member;
twisting said single covered yarn in the same direction as the direction of twist of the covering material; and twisting said covered yarn on said twisting member until said single covered yarn develops a twist equal to the usual twist of a single covering.

2. The process according to claim 1, wherein said covering with a twist comprises a twist of the order of 600 t/m.

3. The process according to claim 2, wherein said covering with a twist is a multi-filament yarn.

4. The process of claim 1, wherein said step of twisting said covered yarn is performed on a double twist spindle.

5. The process of claim 4, wherein said covered yarn is wound on a biconical bobbin.

* * * * *